US009347625B2

(12) United States Patent
Bushee

(10) Patent No.: US 9,347,625 B2
(45) Date of Patent: May 24, 2016

(54) CHEMICAL GLOW DEVICES WITH LED LIGHTING

(71) Applicant: Glenn Bushee, Duxbury, MA (US)

(72) Inventor: Glenn Bushee, Duxbury, MA (US)

( * ) Notice: Subject to any disclaimer, the term of this patent is extended or adjusted under 35 U.S.C. 154(b) by 214 days.

(21) Appl. No.: 14/150,888

(22) Filed: Jan. 9, 2014

(65) Prior Publication Data

US 2014/0192512 A1 Jul. 10, 2014

Related U.S. Application Data

(60) Provisional application No. 61/751,133, filed on Jan. 10, 2013.

(51) Int. Cl.

| | |
|---|---|
| ***F21K 99/00*** | (2016.01) |
| ***F21V 9/08*** | (2006.01) |
| ***F21K 2/06*** | (2006.01) |
| *F21S 9/02* | (2006.01) |
| *F21S 9/03* | (2006.01) |
| *F21Y 113/02* | (2006.01) |

(52) U.S. Cl.
CPC ... *F21K 9/56* (2013.01); *F21K 2/06* (2013.01); *F21K 9/00* (2013.01); *F21S 9/02* (2013.01); *F21S 9/03* (2013.01); *F21Y 2113/02* (2013.01)

(58) Field of Classification Search
CPC ..... F21K 9/56; F21K 9/00; F21V 9/083
See application file for complete search history.

(56) References Cited

U.S. PATENT DOCUMENTS 5,980,055 A * 11/1999 Palmer ..... F21K 2/06 206/219
6,075,322 A * 6/2000 Pauly ..... F21S 9/022 315/127
6,106,129 A * 8/2000 Cranor ..... F21K 2/06 250/462.1
6,676,269 B1 * 1/2004 Dorney ..... A47G 19/2227 362/101
7,104,668 B1 * 9/2006 Lee ..... A44C 15/0015 362/103
8,508,382 B1 * 8/2013 Novak ..... B63C 11/26 114/329
8,882,554 B2 * 11/2014 McKinney ..... B63B 35/7926 362/477
2004/0037085 A1 * 2/2004 Panzarella ..... B60Q 1/326 362/500
2005/0180126 A1 * 8/2005 Steinberg ..... F21K 2/06 362/34
2006/0098420 A1 * 5/2006 Kaplan ..... F21K 2/06 362/34
2006/0291210 A1 * 12/2006 Lee ..... A44C 15/0015 362/249.01
2007/0247843 A1 * 10/2007 Schrimmer ..... F21V 21/0824 362/231
2008/0094825 A1 * 4/2008 Silver ..... F21S 6/001 362/161
2008/0291658 A1 * 11/2008 Cranor ..... F21K 2/06 362/34
2009/0052172 A1 * 2/2009 Sheng ..... G02B 6/001 362/240
2009/0175024 A1 * 7/2009 Cranor ..... F21K 2/06 362/34
2010/0039243 A1 * 2/2010 Tuan ..... G08B 7/06 340/326
2010/0259922 A1 * 10/2010 Johnson ..... A01K 27/006 362/105
2010/0302759 A1 * 12/2010 Hallowell ..... B42D 9/004 362/34
2010/0302760 A1 * 12/2010 Jin ..... F21K 2/06 362/34
2014/0003026 A1 * 1/2014 Friedson ..... F21K 2/06 362/34
2014/0092579 A1 * 4/2014 Jin ..... F21K 2/06 362/34
2014/0286048 A1 * 9/2014 Riello ..... G09F 13/18 362/608

* cited by examiner

*Primary Examiner* — Elmito Breval
(74) *Attorney, Agent, or Firm* — Lawrence J. Shurupoff

(57) ABSTRACT

The performance of chemical glow lights is enhanced by the provision of a battery-powered light-emitting diode (LED). The LED can be provided inside a pouch containing chemicals which, when mixed together, produce a glowing light. Multiple pouches can be provided in strip form as well as in individual form with varying shapes and sizes. Surfaces coated with light-activated photochemicals can be illuminated with one or more LEDs thereby causing such surfaces to produce a chemical glow for extended periods of time.

18 Claims, 3 Drawing Sheets

PRIOR
ART

PRIOR
ART

CHEMICAL GLOW DEVICES WITH LED LIGHTING

CROSS REFERENCE TO RELATED APPLICATIONS

This application claims the benefit and priority of U.S. provisional application No. 61/751,133 entitled "Chemical Glow Devices with LED Lighting" filed Jan. 10, 2013 and which is incorporated herein in its entirety.

BACKGROUND

Chemical glow products have been in use for decades. A common variety employs a combination of at least two chemicals which, when mixed, produce a glowing light for a limited period of time. Typically, these products produce a low level of light for up to about eight hours.

Such products are available in the form of sticks and more recently in the form of pouches. These products are available commercially from Cyalume Technologies Inc., West Springfield, Mass. 01089, under the brands Cyalume, Vis-P ad and formerly, CyPad. An example of a chemical light pad is schematically depicted in FIGS. 1 and 2. The light pad 10 is fainted with a clear plastic pouch 12 which allows for the passage of light. Pouch 12 can be formed from two sheets 14 of clear plastic hermetically bonded or staked along a border 16.

Tightly sealed within the pouch 12 is a porous fabric 18 impregnated with one or more first chemicals for producing light. Also sealed within the pouch 12 is a thin foil packet or other frangible container 20 within which is sealed one or more second chemicals, typically in gel form for mixing with the first chemical.

The foil packet 20 may be bonded to one ply or sheet 14 with adhesive 24 while the fabric 18 may be bonded to the other sheet 14 or alternatively bonded or staked between the two sheets 14. A rigid plastic punch 26 is provided in the pouch 12. Manually pressing or bending the pouch 12 against or around the punch 26 causes the punch to pierce or rupture the foil packet 20.

Upon rupture, the second chemicals are released from the foil packet 20 and mixed with the first chemicals in the porous fabric 18. Additional mixing of the chemicals is carried out by kneading and manually pressing the light transmitting pouch 12. Once thoroughly mixed, the chemicals produce a glowing light through the pouch 12. The glowing light 10 can then be mounted to a surface by an adhesive layer 30. Layer 30 is exposed by removing a peel-away cover 32.

BRIEF DESCRIPTION OF THE DRAWINGS

In the drawings.

In the various figures of the drawings, like reference numerals designate like or similar parts.

DESCRIPTION OF REPRESENTATIVE EMBODIMENTS

Figure 1:
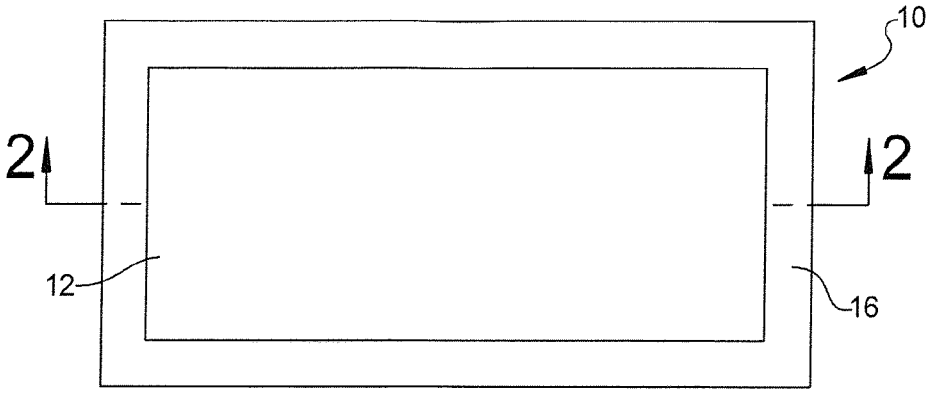
FIG. 1 is a top plan view of a chemical light pad.
Figure 2:
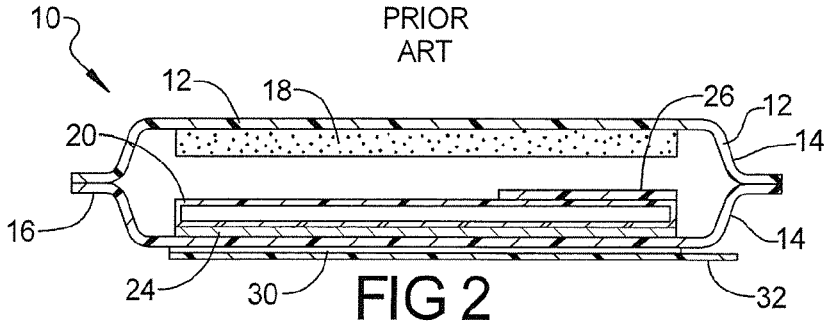
FIG. 2 is a view in section taken along line 2-2 of FIG. 1.
Figure 3:
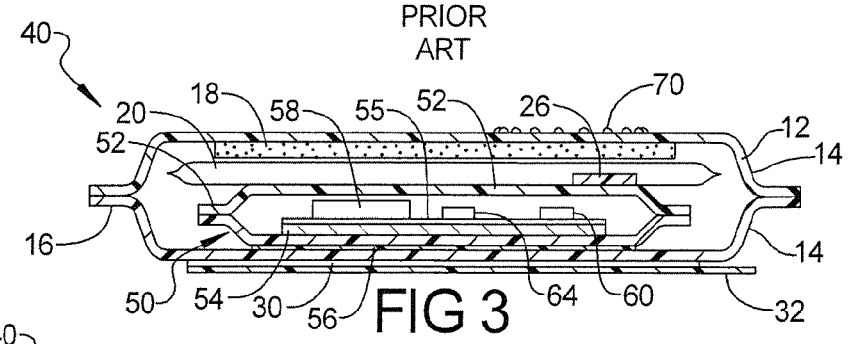
FIG. 3 is a view in section taken along line 3-3 of FIG. 4.
Figure 4:
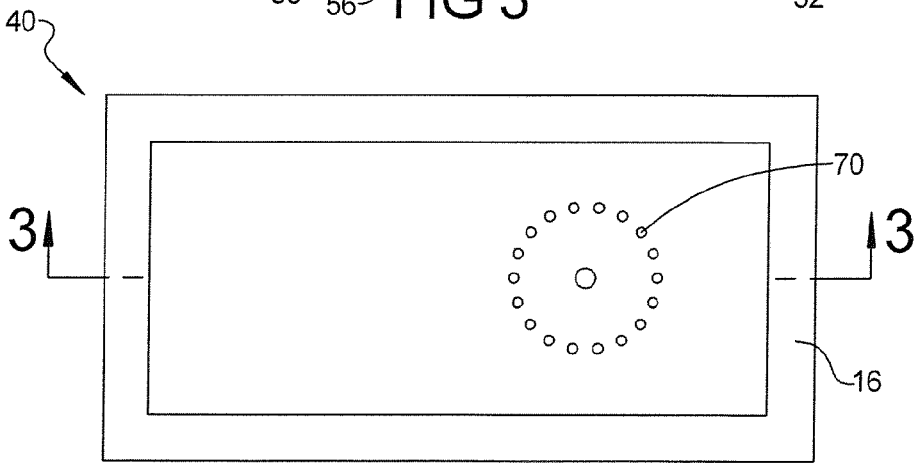
FIG. 4 is a top view of a light assembly constructed in accordance with a representative embodiment of this disclosure.

While the light 10 discussed above functions adequately, there are some applications where the light produced by the mixed chemicals is not bright enough and/or not of sufficient duration. To remedy this condition, a supplemental light source is provided within pouch 12 in accordance with this disclosure. As seen in FIGS. 3 and 4, a light assembly 40 is provided with two different sources of light.

The first light source is the same as described above wherein a fabric 18 carries one or more first chemicals and a sealed packet 20 carries one or more second chemicals. While the packet 20 described above is typically formed with a thin opaque foil, it is contemplated to use a clear foil in this embodiment to allow for the passage of light from a second source of light through the packet 20. However, this is not always required.

It should be noted that the fabric 18 can be eliminated and the pouch 12 simply filled with one or more desired first chemicals, leaving space for the remaining separately sealed second chemical components.

As further seen in FIGS. 3 and 4, a hermetically sealed second light source 50 is also provided within the pouch 12 which can also be hermetically sealed around its border 16. Light source 50 is described in detail in PCT/US2011/025668 and which is incorporated herein in its entirety by reference. Light source 50 includes a flexible outer clear plastic light transmitting cover 52 which encapsulates a support platform such as a circuit board 54. The cover 52 can be provided with a layer of tacky adhesive 56 which anchors the secondary light source 50 to an inner wall of the pouch 12.

Circuit board 54 includes control circuitry 55 of known design for producing one or more light operating modes. For example, the secondary light source 50 is commercially available from Brite Strike Technologies Inc., Plymouth, Mass., under the brand APALS. A battery 58, on-off latching button switch 60 and light emitting diode (LED) 64 are mounted on the circuit board 54 and interconnected by the control circuitry 55.

The LED 64 can be selectively switched on and off by manually depressing the flexible cover 52 onto the switch 60 through the flexible plastic pouch 12. Dimples, bumps or other surface texture 70 can be provided on the outer surface of the flexible plastic pouch 12 and aligned over the switch 60 so an operator can easily locate by feel and actuate the switch 60 by pressing on the textured surface 70. Packet 20 is also flexible and can transmit the actuating force from the outer surface of pouch 12 to the switch 60 via the cover 52.

The LED 64 can be cycled through any number of operating modes provided by circuitry 55. For example, by repetitively pressing switch 60, the LED can be turned on in a bright steady mode, then switched to a dim mode, then to a strobed mode, then back to an off mode. The circuitry 55 can be arranged to produce any desired sequence of bright and dim light intensity and combined with both steady and fast or slow strobed light functions.

In use, an operator can activate the chemical glow light function by pressing or bending or otherwise forcing the pouch 12 over or around the plastic punch 26 so as to rupture the sealed chemical packet 20 and so as to release one or more of the second chemicals into the pouch 12. The second chemicals are then mixed with the first chemicals on the porous fabric 18 or in the surrounding pouch 12 by kneading the pouch 12.

If it is desired to increase the light output (lumens) of the glowing chemical light 10 of the light assembly 40, a user can simply squeeze or press against the pouch 12 to actuate the button switch 60 and illuminate the second battery-powered LED light source in any of its selectable operating modes. The light provided by the LED 64 is generally much brighter than the light provided by the chemical light 10.

The light from the LED 64 is diffused through the first and second mixed chemicals which act as a diffuser lens to spread the projected beam of light from the LED 64 across and through the surface of the pouch 12. This dramatically increases the intensity and visibility of the light emitted by the light 40 and provides an improved glow product that can be used effectively for low light and nighttime signaling or marking a position or area.

While the useful life of the chemical glow 10 light is about 8 hours, the life of the LED light source 50 is up to 80 hours or more. Thus, if the chemical glow light 10 expires, the secondary LED light source will continue to operate for many hours more.

Figure 5:
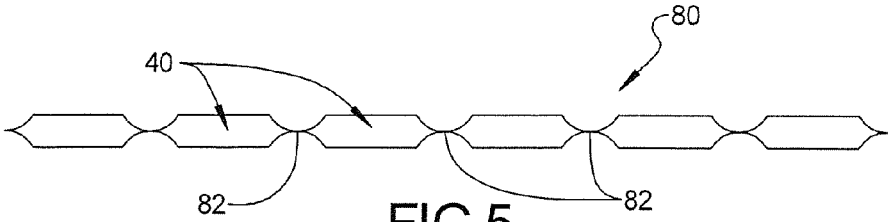
FIG. 5 is a schematic view of a continuous segmented strip of light assemblies.

As seen in FIG. 5, a series of lights 40 can be provided in a single strip 80. The individual lights 40 can remain in an integral strip in use, or be detached as single, double or any other number of integrally connected lights 40. Perforations or tear sections 82 can be formed between each light 40 for easy separation.

Figure 6:
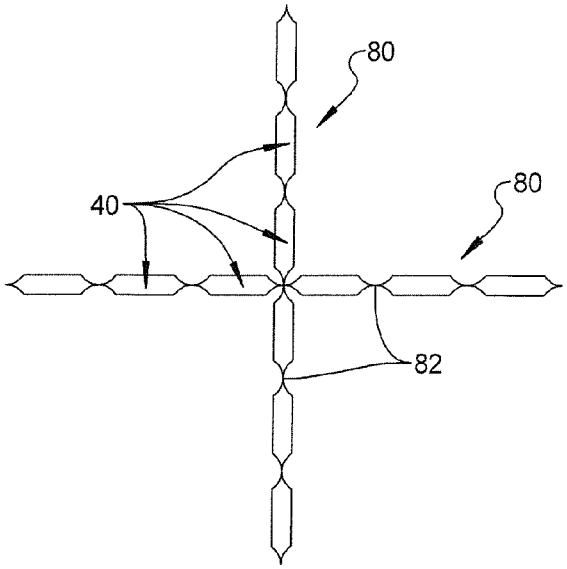
FIG. 6 is a schematic view of two of the light assembly strips of FIG. 5 arranged in a cross pattern.

The light strips 80 can be arranged in any desired pattern to provide a marker or signal in low light conditions. For example, in FIG. 6, two light strips 80 are arranged in a cross to mark a spot which can be seen from afar, even through fog or precipitation. The marker of FIG. 6 can be seen from the air, even through light clouds.

Figure 7:
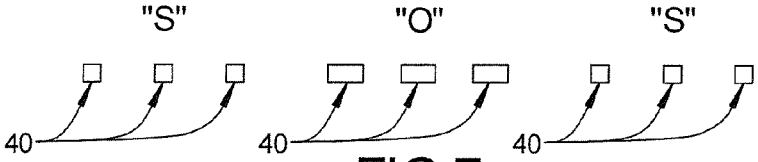
FIG. 7 is a schematic view of different shaped light assemblies arranged in a coded pattern.

It should be noted that the light strips 80 can be arranged to spell words in block letters, such as "HELP." Alternatively, the lights 10 can be produced in different lengths so as to create a coded message. As seen in FIG. 7, the universal help signal "SOS" has been produced in Morse code using a series of short and long lights 40 to represent dots and dashes.

Figure 8:
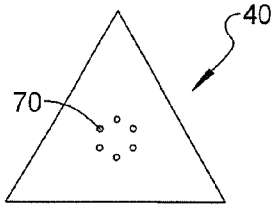
FIGS. 8 through 10 are schematic views of various shapes of light assemblies.
Figure 9:
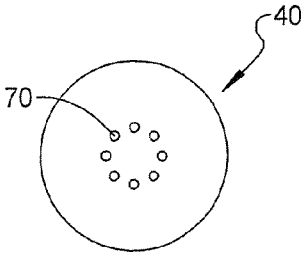
Figure 10:
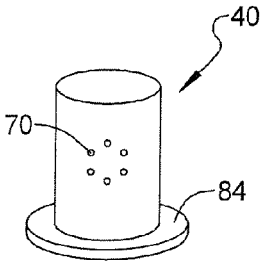

The lights 40 can be produced in virtually any desired shape such as triangular (FIG. 8), circular (FIG. 9) and cylindrical (FIG. 10). In FIG. 10, the cylindrical light 10 can be provided with a fixed or detachable annular base 84.

While the secondary LED light source 50 has been described above for use with a two component chemical glow light, the light source 50 can also be used with other glow chemicals. For example, some glow chemicals have glow properties that require a separate light source to shine on them to initiate a glow and to charge or activate the chemicals so as to produce a glow. These types of glow chemicals are commonly used on glow-in-the-dark dials on wrist watches.

By activating these types of glow chemicals with the secondary light source 50, these chemicals can maintain a continual charge which produces a glow for many hours, up to 80 hours or more. These types of glow chemicals are available as liquids and gels and can be applied as a coating to virtually any surface and dried to a paint-like finish. One example is the coating of bicycle tire rims with a glow chemical for night riding safety.

Figure 11:
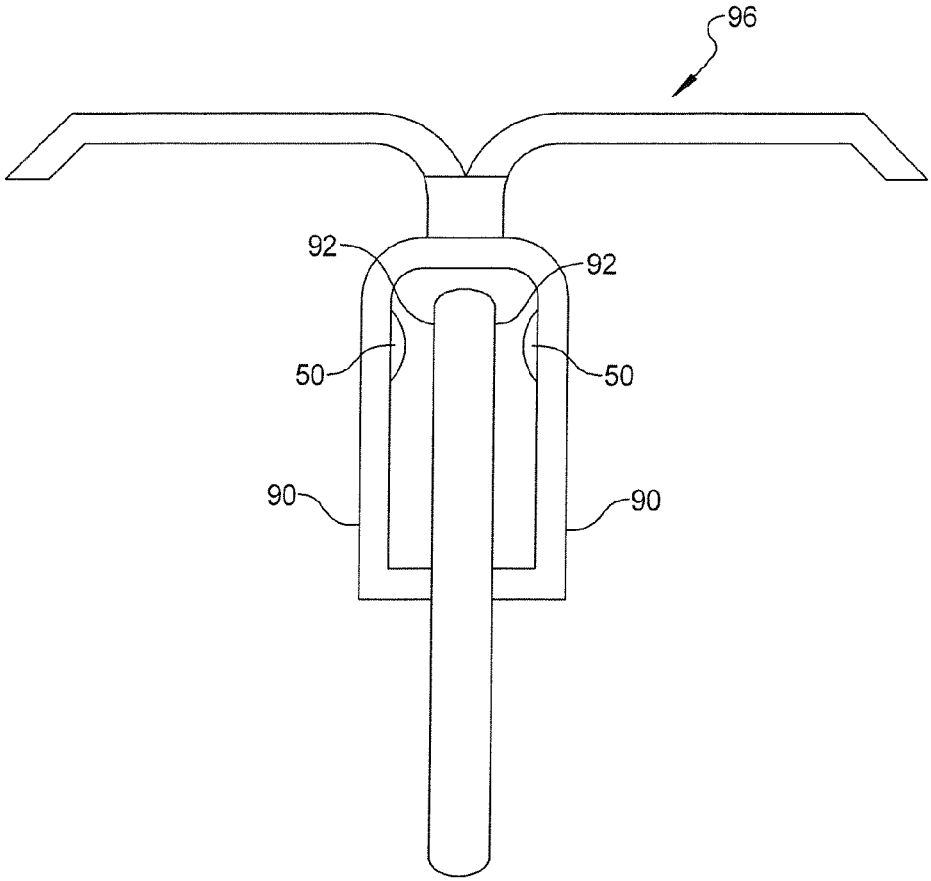
FIG. 11 is a schematic view of a pair of light assemblies mounted on a bicycle frame.

A bicycle rider typically activates the glow coating on the tire rim with a flashlight However, the effective glow only lasts for a few minutes. As seen in FIG. 11, by mounting an LED light source 50 on the forks 90 of a bicycle 96 adjacent or juxtaposed the tire rims 92, the light from the LEDs continuously or intermittently can shine on the rotating rims and charge them continuously for a long continuous glow. In this example, the light source 50 is not integral with the glow chemicals but is spaced apart over a short distance.

It can be appreciated that the performance of current chemical glow products can be enhanced with a secondary long life battery-powered LED light. The LED light can be provided in a pouch and surrounded by glow chemicals or spaced apart from glow chemicals to activate them. The blinking or strobed mode of the LED light 50 accentuates the visibility of the lights 40 as well as the visibility of the chemical glow lights and can increase the run time of the battery powered LED 64.

In some cases, it is desirable to further extend the life of the LED battery 58 from about 80 hours of run time to several hundred or several thousand hours of run time so that LED 64 is illuminated an equally extended amount of time. This can be achieved with the use of a rechargeable battery 58 and an external source of battery charge such as provided with a photovoltaic cell or solar panel.

Figure 12:
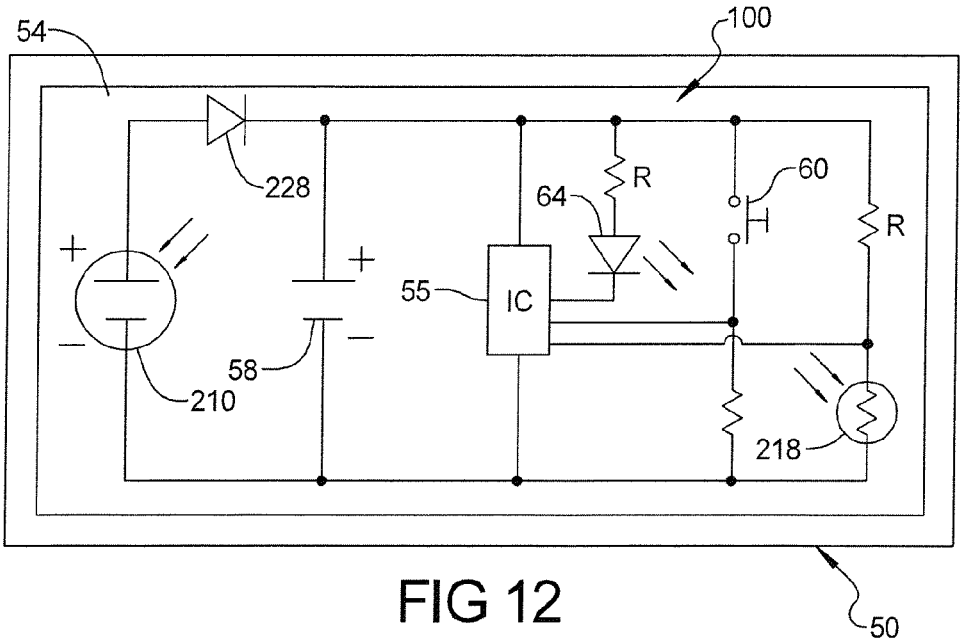
FIG. 12 is a schematic circuit diagram of a light assembly provided with a rechargeable battery, solar cell and optional light-actuated on-off switch.

For example, as seen in FIG. 12, circuit board 54 is provided with operating circuitry 100 including control circuitry 55. The use of a small solar panel or solar cell 210 to "trickle charge" the rechargeable battery 58 provides extended operating life to the battery and to the LED 64 from two to five years of service and longer, as the technology for both solar panel and battery technology improves.

While this solar powered light source 50 has direct applications for military operations, there is also a major advantage to the consumer market for all of the current uses of an extended life light source 50 with the added benefit of thousands of hours of runtime rather than hundred of hours of runtime without a solar panel battery charger.

The use of a solar panel or solar cell 210 on light source 50 is "green" or sustainable in that the current battery powered LED lighting systems disclosed above are disposable after 80 to 100 hours or so of use compared to years of use with a rechargeable light source 50. Moreover, the cost per hour of runtime can be reduced to fractions of a cent.

The use of solar panels or solar cells 210 on the light source 50 described above can be combined with a conventional light-actuated photo switch 218 wired to the microcircuitry 55. The light-actuated switch 218 can take the form of a photoresistor, a photocell, a photodiode, a phototransistor or any similar light-actuated switch or light sensor for controlling or limiting the illumination of the LED 64. The technology for light-actuated switches has improved so that their size is small and thin enough to fit onto the top of circuit board 54. The photo switch 218 can be held in place by an insulating epoxy resin.

The microcircuitry 55 can take the form of a programmable controller or microcontroller to perform the lighting functions and operations as disclosed above. Inputs to the microcircuitry 55 from the switch 60 select a particular operating mode. When a light-actuated switch 218 is used as an input to the microcircuitry 55, the LED 64 will only operate under predetermined levels of darkness which can be programmed into the microcircuitry 55. In these cases, operation of the LED 64 during daylight may not be required or may not be effective, in which case battery power is conserved for when it is later needed.

When a particular mode of operation of LED 64 is turned off by the light-actuated switch 218 due to the level of ambient light reaching a predetermined brightness, that same operating mode will be returned to operation when the level of ambient light decreases to a predetermined level of darkness.

A diode 228 can be placed between the solar cell or solar panel 210 and the battery 58 to prevent battery discharge through the solar cell or solar panel 210 during periods of darkness.

The light-actuated switch 218 wired as shown in FIG. 12 along with the switch 60 allows a single rechargeable battery to recharge more efficiently from the solar panel 210 as the switch 218 cuts off the light output from the LED 64 during daylight hours when the LED light 64 is not typically needed, i.e. from dawn to dusk. Because the LED 64 is not powered at this time, the battery recharges faster. The LED 64 will operate in whichever switch mode it is left in when the outside ambient light dims down to a low lux level that is equivalent to dusk or to a very cloudy day or to a heavy sand storm. The addition of a light-actuated switch 218 can increase the operational battery run time up to 200% or more. Additional details of a solar powered LED are described in U.S. Patent Publication US2013-0314902 A1, which is incorporated herein by reference in its entirety.

There has been disclosed heretofore the best embodiments presently contemplated. However, it is to be understood that various changes and modifications may be made thereto without departing from the spirit of the disclosure.

What is claimed is:

1. A lighting assembly, comprising:

a first light comprising at as two chemicals which were mixed together produce a low intensity glow for a first period of time;

a second light comprising a battery-powered LED arranged to project LED light having a light intensity greater than said low intensity glow onto said at least two chemicals, said second light providing said LED light for a second period of time greater than said first period of time; and said LED light increasing said low intensity glow of said first light and increasing visibility of said lighting assembly by diffusing through said first light.

2. The light assembly of claim 1, wherein said at least two chemicals are separated apart prior to producing said glow.

3. The light assembly of claim 2, wherein a first one of said chemicals is encased in a light transmitting pouch.

4. The light assembly of claim 3, wherein a second one of said chemicals is encased in a packet designed to be ruptured within said pouch.

5. The light assembly of claim 4, wherein said first and second chemicals and second light are encased in said pouch.

6. The light assembly of claim 5, wherein said second light is sealed within a clear plastic cover provided in said pouch.

7. The light assembly of claim 6, further comprising an adhesive layer provided on said pouch.

8. The light assembly of claim 1, further comprising a plurality of said first and second lights arranged in a strip.

9. The light assembly of claim 1, further comprising an on-off switch controlling battery power to said LED.

10. A light assembly, comprising:

a light transmitting sealed pouch;

a first light source comprising a first chemical provided in said pouch, a second chemical provided in said pouch and separated from said first chemical, and wherein manual mixing of said first and second chemicals produces a glowing light through said pouch;

a light transmitting cover provided in said pouch;

a second light source provided in said light transmitting cover and comprising a support platform supporting a battery, a switch, a second light and control circuitry controlling said second light wherein said light transmitting pouch seals said first and second light source from ambient conditions and said second light having an intensity greater than said glowing light and selectively increasing visibility of said first light source by diffusing through said first light source.

11. The light assembly of claim 10, wherein said switch comprises an on-off switch turning said second light on and off and operated by manually depressing said pouch over said on-off switch.

12. The light assembly of claim 10, wherein said support platform comprises a circuit board and said battery comprises a rechargeable battery supported by said circuit board.

13. The light assembly of claim 12, further comprising a solar powered battery charger providing voltage to said rechargeable battery.

14. The lighting assembly of claim 13, further comprising a light-actuated switch controlling operation of said second light.

15. The light assembly of claim 10, wherein said control circuitry selectively powers said second light in a strobed operating mode.

16. A light assembly, comprising:

a first light source comprising a plurality of chemicals which when mixed together produce a glowing light with a first level of light intensity for a limited period of time;

a second light source comprising a switch and a battery-powered LED producing light for an extended period of time longer than said limited period of time, said second light source producing a second level of light intensity greater than said first level of light intensity;

said second light source increasing said first level of light intensity by projecting light from said battery-powered LED onto said first light source; and said first and second light sources selectively and independently illuminated by an operator by selectively manually mixing said plurality of chemicals to produce said glowing light and by selectively switching on said battery-powered LED by operating said switch.

17. The light assembly of claim 1, wherein said second light source diffuse through said second light source.

18. The light assembly of claim 16, wherein said second light comprises a plurality of operating modes including a steady on mode and a strobed mode, said operating modes selected by an operator operating said switch.

* * * * *